United States Patent [19]

Nielsen

[11] 4,177,921

[45] Dec. 11, 1979

[54] ONE PIECE CHYLOMICRON ROTOR LINER

[75] Inventor: Steven T. Nielsen, Sunnyvale, Calif.

[73] Assignee: Beckman Instruments, Inc., Fullerton, Calif.

[21] Appl. No.: 837,659

[22] Filed: Sep. 29, 1977

[51] Int. Cl.[2] ..... B04B 1/00

[52] U.S. Cl. ..... 233/20 R; 233/1 E; 233/27

[58] Field of Search ..... 233/1 R, 1 A, 1 E, 14 R, 233/20 R, 27, 28

[56] References Cited

U.S. PATENT DOCUMENTS

| | | | |
|---|---|---|---|
| 3,244,363 | 4/1966 | Hein | 233/20 R |
| 4,056,225 | 11/1977 | Hein | 233/20 R |

*Primary Examiner*—George H. Krizmanich

*Attorney, Agent, or Firm*—R. J. Steinmeyer; F. L. Mehlhoff; William H. May

[57] ABSTRACT

An improved multicompartment rotor liner which essentially eliminates the possibility of contamination of centrifugated clarified serum upon retrieval of the serum from the liner. The liner has an annular chamber surrounding a central chamber in which the chyle material is collected during centrifugation from a chylous serum. The present liner invention incorporates a unique flat cover to prevent the accumulation of chyle in the central chamber above the seal junction between the annular chamber and the central chamber. This unique configuration also allows for greater ease of pipette insertion.

3 Claims, 3 Drawing Figures

ONE PIECE CHYLOMICRON ROTOR LINER

BACKGROUND OF THE INVENTION

This invention relates to the field of centrifuge rotors and, more particularly, relates to a one piece rotor liner having a convolute configuration defining separate chambers which are automatically sealed and unsealed from each other during the centrifugation operation.

In the recent development of air driven ultra high speed centrifuges, a new rotor liner configuration has been developed which establishes at least two separate and distinct chambers within the rotor. These chambers are in fluid communication with each other during the high speed centrifugation operation, but assume sealing engagement from each other subsequent to the centrifugation run to isolate specific centrifugated constituents of the sample mixture and avoid remixing. Reference is made to Patent Application Ser. No. 681,312 filed by George N. Hein, Jr. on Apr. 29, 1976 entitled A CENTRIFUGE ROTOR FOR SEPARATING PHASES OF A LIQUId and U.S. Pat. No. 3,096,283 to George N. Hein, Jr. entitled A CONTAINER FOR BLOOD AND MACHINE FOR SEPARATING PRECIPITATES FROM LIQUID BLOOD CONSTITUENTS. Initial methods for making the above referenced rotor liner require the use of two separate pieces to obtain a tight convoluted configuration, necessitating a bonded seal between the respective pieces. The generally enclosed rotor liner has a somewhat cylindrical configuration and the bonding between the two sections of the liner is normally placed along a junction located at the outer circumferential extremity of the annular chamber.

This bonded joint between the lower section of the liner and the cover of the liner establishes a potential weak point in the liner which could be subjected to leakage or rupturing under certain conditions during centrifugation. It has been found that it is extremely difficult to develop a dependable and reliable bonded joint which can withstand the high hydrostatic pressures in the centrifugation operation. An approach to solve this problem is the process of making a one piece convoluted rotor liner having the central chamber and an annular chamber. Reference is made to my copending patent applicaton Ser. No. 684,814 entitled A PROCESS FOR MAKING A ONE PIECE ROTOR LINER filed on May 10, 1976.

The configuration of the one piece rotor liner made by the process discussed in my above referenced patent application incorporates a central raised portion at the location of the access aperture. This central raised portion is located above the sealing junction between the annular chamber and the central chamber. Consequently, this raised central portion establishes a potential collection cavity for the chyle material which is separated from the chyle serum during centrifugation. At the conclusion of centrifugation it is desirable to remove the centrifugated clear serum from the annular chamber. This is typically done by the insertion of a pipette through the central access hole in the liner. However, when the seal is released between the annular chamber and the inner chamber, chyle which is located in the raised central portion of the liner has the potential of possibly falling or receding into the annular chamber of the liner causing contamination of the centrifugated clear serum. It was originally considered essential to have the raised central portion in order to provide adequate strength to the liner and to aid in its compatibility with the proper rotor design.

This particular design has also posed a potential problem with making the insertion of the pipette more difficult by establishing a blockage from the central access port in the liner to the annular chamber. The central raised portion presents a shoulder area which can block entrance of the pipette into the annular chamber.

The existence of the raised central portion in the rotor liner requires that the rotor lid have an enlarged aperture to accommodate this raised central portion. Consequently, the aperture in the rotor lid has a diameter greater than the diameter of the central chamber in the rotor liner. During centrifugation, if a leak would occur in the liner, the fluid mixture may escape not only from the liner, but also from the rotor itself due to the fact that the fluid level line of the mixture in the liner is closer to the spin axis of the rotor than the perimeter of the opening in the rotor lid. This would present an undesirable and unwanted aerosoling of the fluid mixture during centrifugation.

SUMMARY OF THE INVENTION

The present invention comprises a one piece rotor liner of a convolute shape having a central chamber and an annular chamber wherein the top surface is essentially flat with a small central access port or aperture. The flat structure of the top of the liner eliminates the existence of a central raised portion which would establish a cavity above the sealing junction between the annular chamber and the central chamber.

Consequently, during centrifugation none of the chyle material which is separated from the fluid mixture during centrifugation accumulates in any cavity above the sealing junction between the respective chambers. Therefore, during the extraction of the clear serum from the annular chamber there is no potential of residual chyle material entering or receding into the annular chamber and contaminating the clear serum.

Further, the generally flat top configuration of the liner improves the geometry of the liner configuration, so that insertion of the pipette is more convenient and eliminates potential breakage of the pipette in attempting to reach tne annular chamber.

The elimination of the raised central portion of the rotor liner reduces the size of the aperture necessary in the rotor lid for access to the rotor liner. Therefore, the perimeter of the aperture in the rotor lid is closer to the spin axis of the rotor than the fluid line in the rotor liner during centrifugation. Consequently, if a leak should develop in the rotor liner during centrifugation, the fluid will be contained within the rotor and will not escape from the rotor, since the opening in the rotor lid would be small enough to contain the fluid within the rotor.

DETAILED DESCRIPTION OF THE INVENTION

Figure 1:
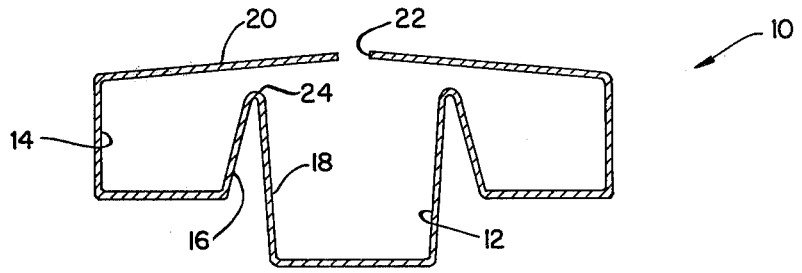
FIG. 1 is a sectonal view of the rotor liner.

The one piece rotor liner 10 of the present invention is shown in FIG. 1 having a central generally cylindrical chamber 12 surrounded by an annular chamber 14. The respective chambers are separated by the inner wall 16 of the annular chamber 14 and the cylindrical wall 18 of the central chamber 12. These walls form a double wall separation between the chambers. Integrally formed over the central chamber 12 and the annular chamber 14 is the liner cover 20 which is generally flat and has an access aperture 22. The rotor liner 10 is made of a somewhat flexible material, so that the cover 20 will flex downward when desirable to engage a sealing junction 24 located at the interface of the double walls 16 and 18.

Figure 2:
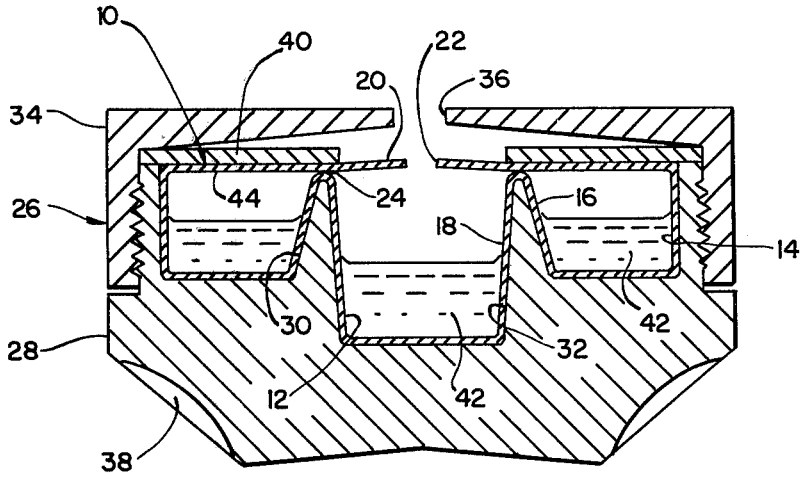
FIG. 2 is a sectional view of the rotor liner mounted within the rotor with the cover of the liner in its orientation when the rotor is stationary.

The rotor liner 10 as shown in FIG. 2 is placed within a rotor 26. The lower portion 28 of the rotor has an annular cavity 30 and a central cavity 32 to accommodate the respective annular chamber 14 and central chamber 12 of the rotor liner 10. Threadably engaged to the lower section 28 of the rotor is a rotor lid 34 having a central opening 36. The rotor 26 is preferably an air driven rotor for use in an air driven centrifuge and has in its lower section 28 a series of flutes 38 which receive the air from a source within the centrifuge (not shown) to rotate the rotor during centrifugation. Located on top of the rotor liner cover 20 is a sealing element 40 which is designed to maintain the sealing engagement of the cover 20 with the sealing junction 24 when the rotor is stationary.

Figure 3:
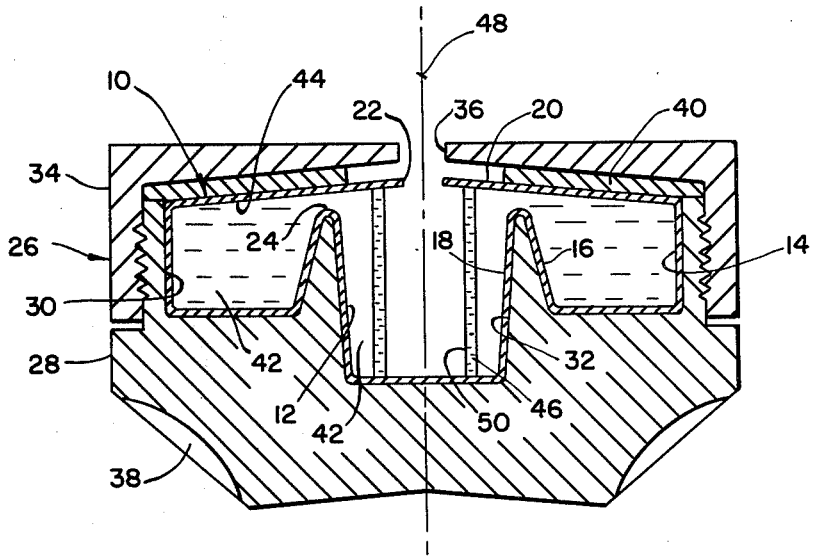
FIG. 3 is a sectional view of the rotor liner in the rotor with the liner cover in its orientation when the rotor is subjected to centrifugation.

As shown in FIG. 3, during centrifugation the fluid mixture 42 which is located in both the central chamber 12 and the annular chamber 14 exerts a force against the bottom surface 44 of the cover 20 on the rotor liner to force the cover 20 upward against the bias of the sealing element 40 and allow an opening between the annular chamber 14 and the central chamber 12. This permits fluid communication between the annular chamber 14 and the central chamber 12. Reference is made to the previously cited patent application filed by George Hein entitled A CENTRIFUGE ROTOR FOR SEPARATING PHASES OF A LIQUID. In this patent an explanation is presented with respect to the operation of the sealing element 40 in conjunction with the rotor liner during and subsequent to centrifugation.

Reference is also made to my copending patent application entitled A PROCESS FOR MAKING A ONE PIECE ROTOR LINER. In this application a process is disclosed for making a one piece rotor liner similar to that shown in FIG. 1.

Turning to the operation of the present invention, reference is made to FIG. 2 where the rotor 26 is stationary and the sealing element 40 establishes a seal between the cover 20 and the sealing junction 24 to isolate the annular chamber 14 from the inner chamber 12 in the liner. Prior to insertion into the rotor 26 the rotor liner 10 receives a fluid mixture 42 which, for example, could be chylous serum. During centrifugation it is desired that the chyle be separated from clear serum for purposes of providing clear serum or chyle for testing or diagnostic evaluation.

During centrifugation, as shown in FIG. 3, fluid communication exists between the annular chamber 14 and the central chamber 12. The chylous serum which is originally placed in both the central chamber 12 and the annular chamber 14 will assume the orientation shown in FIG. 3 with the lighter chyle material 46 creating a cylindrical band adjacent the spin axis 48 while the lighter clear serum will accumulate primarily in the annular chamber 14. When the centrifugation process is complete, the sealing member 40 will force the cover 20 in the liner to engage the sealing junction 24 to isolate the clear serum in the annular chamber 14. This operation of the sealing element 40 is explained in more detail in the previously referenced patent application to George Hein entitled A CENTRIFUGE ROTOR FOR SEPARATING PHASES OF A LIQUID.

Once the centrifugation run is completed and the rotor is stationary, the rotor lid 34 is removed from the lower portion 28 of the rotor. This will allow the rotor cover 20 to assume the orientation shown in FIG. 1 with a space between the sealing junction 24 and the bottom surface 44 of the liner cover 20. Through the use of a pipette an operator can extract the clear serum directly from the annular chamber through the access aperture 22 in the rotor liner. Because the bottom surface 44 of the rotor liner cover 20 is generally flat from its outer perimeter to its access aperture, there is no cavity or area where the chyle material can accumulate. This essentially eliminates the possibility of chyle falling or receding into the annular chamber when the rotor liner 10 is removed from the rotor for extraction of the serum. Further, the cylindrical wall 18 of the central chamber or the top of the double walls 16 and 18 determines the upper limit of the central chamber, so that no chyle will accumulate above the height of the cylindrical wall 18. In some instances it may be desirable to remove through the central opening 36 in the rotor lid 34 as well as through the access aperture 22 in the rotor liner the chyle material 46 prior to removal of the rotor liner 10 from the rotor.

One important aspect of having the cover 20 of the rotor liner 10 flat relates to the fact that the rotor lid 34 can have a relatively small central opening 36. The importance of this feature is that, during centrifugation, the surface line 50 of the fluid mixture 42 is further away from the spin axis 48 than the perimeter of the central opening 36 in the rotor lid 34. Consequently, if a leak should occur anywhere in the liner during centrifugation, the fluid mixture will be retained within the rotor 26 to prevent any aerosoling or escape of this fluid mixture during centrifugation. Otherwise, if the central opening 36 were larger with a perimeter which was farther away from the spin axis 48 than the level 50 of the fluid, any leak which may occur in the rotor liner would escape from the rotor since the rotor lid would not enclose the liner enough to contain the fluid mixture escaping from the rotor liner 10.

Because the rotor liner is preferably made of a semi-flexible material in a process similar to that disclosed in copending application entitled A PROCESS FOR MAKING A ONE PIECE ROTOR LINER, insertion of the pipette into the rotor liner 10 is easier and with less chance of pipette breakage, since the generally flat cover 20 of the liner is flexible. Another important result of using a flat top configuration of the rotor liner is due to the fact that the lid 34 of the rotor can be essentially flat with no protrusions and, therefore, may decrease possible windage problems or potential drag problems at operating speed during centrifugation.

What is claimed is:

1. A multicompartment rotor liner for receipt of a fluid mixture and for use in a centrifuge rotor, said liner comprising:

a lower portion having a generally cylindrical central chamber and an annular chamber surrounding said central chamber, said central and annular chambers being separated by a double wall, said annular chamber receiving one constituent of said mixture during centrifugation and said central chamber receiving another constituent of said mixture during centrifugation; and a cover integrally formed with said lower portion and having a central access aperture, the top of said double wall establishing the upper limit of said central chamber, said cover when in engagement with said top of said double wall defining the vertical extent of the top of said central chamber to prevent the establishment of a cavity in said central chamber above said top of said double wall, so that none of said another constituent will accumulate above said top of said double wall when said liner is in said rotor and subjected to centrifugation to eliminate inadvertent introduction of said another constituent into said annular chamber when a pipette is inserted through said central access aperture to said annular chamber.

2. A multicompartment centrifuge rotor for separating constituent parts of a fluid mixture, said rotor comprising:

a rotor bottom containing a central cavity and an annular cavity surrounding said central cavity;

a rotor liner positioned within said rotor bottom and having a central cylindrical chamber and an annular chamber received within said central and annular cavities respectively;

a flexible cover integrally formed on said rotor liner with an access aperture; and a rotor lid secured to said rotor bottom over said rotor liner and having a central opening that is uncovered during centrifugation, said central opening being smaller than said central cylindrical chamber, so that the level of said fluid mixture in said liner during centrifugation is farther from the spin axis of said rotor than the perimeter of said central opening in said rotor lid is from said spin axis to insure that any leakage of said fluid in said liner will be contained within said rotor during centrifugation.

3. A multicompartment centrifuge rotor as defined in claim 2 and additionally comprising means positioned adjacent one of said chambers for sealing one of said chambers from the other of said chambers, said sealing means being responsive to the centrifugally induced force of said fluid mixture in said one chamber as said rotor accelerates from a stationary position to high speed rotation to automatically allow fluid communication between said chambers, said sealing means automatically sealing said one chamber from said other chamber as said rotor decelerates from said high speed rotation to said stationary position.

* * * * *